United States Patent [19]

Knobeloch

[11] Patent Number: 4,601,076

[45] Date of Patent: Jul. 22, 1986

[54] LOUNGING/SLEEPING APPARATUS

[76] Inventor: Marcia L. Knobeloch, P.O. Box 10069, Alexandria, Va. 22310

[21] Appl. No.: 675,788

[22] Filed: Nov. 28, 1984

[51] Int. Cl.[4] ..... A47G 9/08

[52] U.S. Cl. ..... 5/413; 5/420

[58] Field of Search ..... 5/413, 417, 497, 500, 5/502, 482, 420; 2/69.5

[56] References Cited

U.S. PATENT DOCUMENTS

| | | | |
|---|---|---|---|
| 666,034 | 1/1901 | Solomon | 2/69.5 |
| 1,263,825 | 4/1918 | Waugh | 5/413 |
| 1,583,419 | 8/1925 | Perl . | |
| 2,060,092 | 9/1935 | Lucas . | |
| 2,567,072 | 11/1947 | Kay . | |
| 3,178,734 | 2/1962 | Carrez | 5/413 |
| 3,798,686 | 3/1974 | Gaiser | 5/413 |
| 3,832,743 | 9/1974 | Smith | 5/496 |
| 3,962,739 | 6/1976 | Crocket | 5/497 |
| 4,087,874 | 5/1978 | Callaway et al. | 5/413 |
| 4,164,797 | 8/1979 | Golembeck | 5/470 |
| 4,329,747 | 5/1982 | Russell | 5/420 |
| 4,413,368 | 11/1983 | Schuetze | 4/494 |

FOREIGN PATENT DOCUMENTS

| | | | |
|---|---|---|---|
| 2396490 | 3/1979 | France | 5/413 |

*Primary Examiner*—Alexander Grosz

*Attorney, Agent, or Firm*—Griffin, Branigan & Butler

[57] ABSTRACT

A lounging/sleeping apparatus (10) includes a combination rectangularly-shaped heavy-woven bag-like container (20) and a rectangularly-shaped flannel cover sheet (22) permanently sewn together only at a seam at the foot end of each of these elements, with the container having enclosed therein a thin rectangular sheet (14) of resilient polyurethane foam material and the cover sheet being substantially wider than the bag-like container. The sleeping apparatus is foldable into a roll (48) and includes attached ties for maintaining it in such a roll.

8 Claims, 6 Drawing Figures

LOUNGING/SLEEPING APPARATUS

BACKGROUND OF THE INVENTION

This invention relates broadly to the art of portable sleeping devices, and more specifically to informal, lounging/sleeping devices with which one can sleep or rest on the floor of a house and the like.

It often occurs that people wish to be in reclining positions in house areas where there is no reclining furniture. This occurs, for example, when young children, or teens, have slumber parties and many more children wish to be in a specific room than there are beds in that room. Other examples are, people sometimes wish to lie close to a television set although there is no reclining furniture there, people sometimes wish to spend the night in a house although there are not enough beds there and preschools often have pupils take naps on a floor without beds.

In the past people have solved this problem by setting up cots, sleeping on sofas, sleeping on the floor in sleeping bags, placing cushions from furniture on the floor and then sleeping on them with sleeping bags, simply sleeping on the floor, etc. Using cots is cumbersome and their storage takes up undue space. Sleeping on furniture is bad for the furniture and is usually quite uncomfortable for sleepers. Although sleeping bags are convenient from a storage and portability point of view, they are often too warm for a house and are generally uncomfortable because they unduly restrict body movement and offer very little resilient support under the sleeper. Further, they are expensive to clean. Sleeping bags combined with inflatable mattresses, or cushions from furniture, are much more comfortable than sleeping directly on the floor, however, inflatable mattresses are expensive, furniture cushions can be damaged, and both add undue bulk as far as portability and convenience is concerned.

It is an object of this invention to provide a lounging/sleeping apparatus which can be conveniently used in a house which is: inexpensive, highly portable, not unduly bulky, firm but resilient, supportive for a reclining person, durable, easy and inexpensive to maintain and very comfortable to sleep on in a house or outdoors in mild weather.

SUMMARY

According to principles of this invention, a rectangular bag-like container of durable cloth material is seamed at its foot only to the foot of a rectangular cover sheet of softer warm material. The bag-like container contains a single integral rectangular sheet of resilient foam material having sufficient firmness that when it is spread out it provides a comfortable support for a human body to lie on. The cover sheet has a width which is substantially wider than that of the cloth container. The sleeping apparatus can be folded into a roll and includes ties for holding the roll in its rolled shape. The bag-like, cloth, container is constructed of a heavy-woven fabric such as broadcloth, the cover sheet is constructed of flannel and the foam material is polyurethane foam.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENTS

Figure 1:
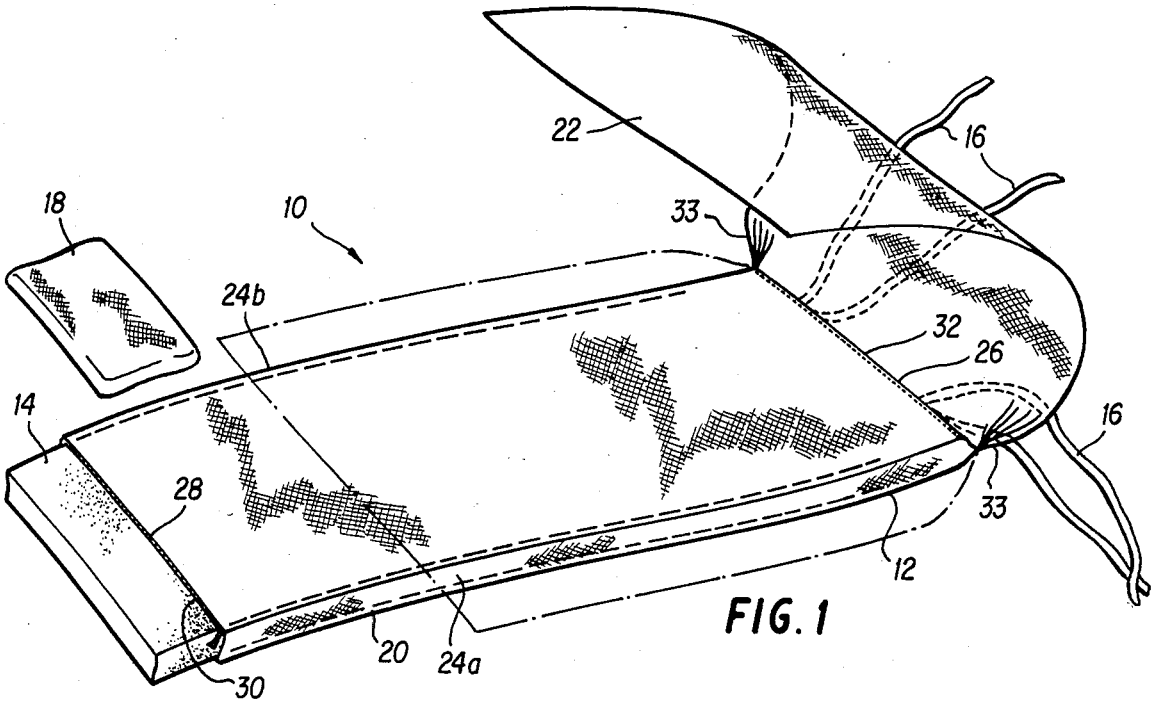
FIG. 1 is an exploded isometric view of the sleeping apparatus of this invention.

Referring the drawings, lounging/sleeping apparatus 10 comprises a composite container/sheet member 12, an integral, thin, rectangular sheet of resilient foam material 14, ties 16, and a pillow 18.

Figure 5:
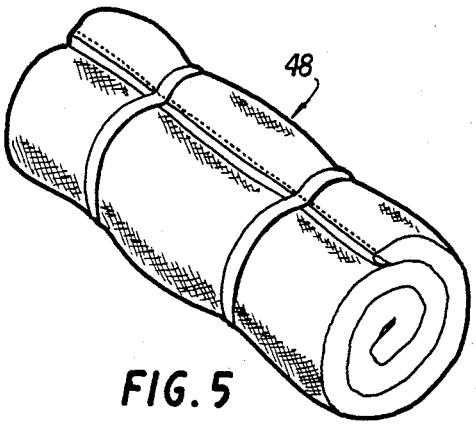
FIG. 5 is an isometric view of the FIG. 1 structure when it is folded into a roll; and, FIG. 6 is an end view of the structure shown in FIG. 5.
Figure 6:
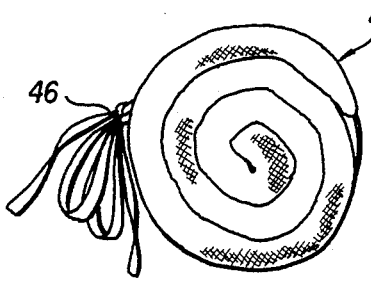

The composite container/sheet member 12 includes a container portion 20 and a cover sheet portion 22. The container portion 20 forms a rectangular container which is closed at its sides 24A and B and at its foot end 26, but which can be selectively opened at its head end 28, this end having a zipper 30 thereat. The container portion 20 is sized to snugly contain a single, integral, thin rectangular sheet of resilient foam material 14. This foam material is perferably a polyurethane foam which is 24 inches wide and 2 inches thick. The length is variable depending on the size of a person expected to use the sleeping apparatus 10. In this regard, the sleeping apparatus, and therefore the sheet of foam material 14, is presently made to be either 3 feet, 5 feet, or 6 feet long. The 3 feet long sleeping apparatus is only 20 inches wide rather than being 24 inches wide and, of course, is normally for a small child. The sheet of polyurethane foam material 14 has a sufficient firmness that when it is spread out it provides a comfortable support for a human body lying thereon from a floor. Further, the foam material is sufficiently resilient that it can be folded into a roll as is depicted in FIGS. 5 and 6 but it is highly durable so that these activities do not cause it to disintegrate from extensive use. The foam sheet remains as a single integral sheet which can be easily, independently handled when it is not in the container portion 20. The container portion 20 is formed of a somewhat heavy, durable material which is a heavy-woven fabric such as broadcloth, but sometimes is denim or other similar materials. In one embodiment a cotten and polyester blend broadcloth is used.

A cover sheet portion 22 has a width which is substantially wider than the width of the container portion 20 and the sheet of foam material 14 and its foot end 32 is sewn into the foot end seam 26 of the container portion 20. The cover sheet portion 22 is almost as long as the container portion 20. In this respect, since the foot end width of the cover sheet portion 22 is wider than that of the container portion 20, the cover sheet portion 22 is gathered at corners 33 shown in FIG. 1 in order to make the foot ends match. The cover sheet portion 22 is of softer material than the material used for the container portion 20, but yet it is also sufficiently thick to be warm. In this respect, flannel has proven to be the most satisfactory material of which to form the cover sheet portion 22. Of course it is not necessary for the cover sheet portion 22 to be as durable as the container portion 20.

Also sewn into the foot end seam 26 are the cloth ties 16 whicn are cut and sewn from the same material as is the container portion 20 and, in the preferred embodiment, it is not.

Figure 2:
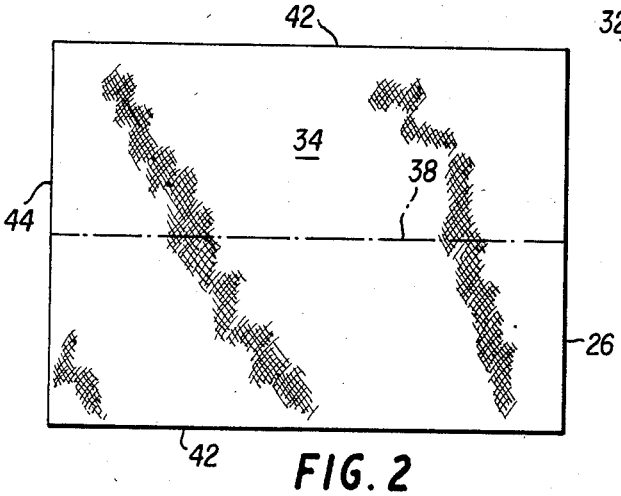
FIG. 2 is a plan view of a blank piece of cloth material from which a bag-like container element of the FIG. 1 apparatus is constructed.
Figure 3:
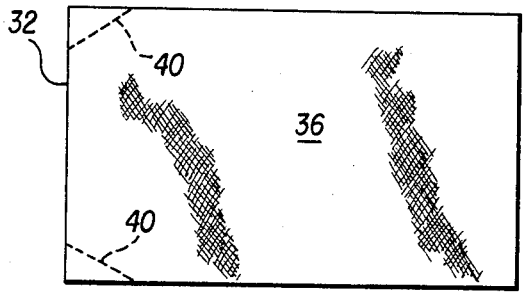
FIG. 3 is a plan view of a blank sheet of cloth from which the cover sheet element of the FIG. 1 apparatus is constructed.
Figure 4:
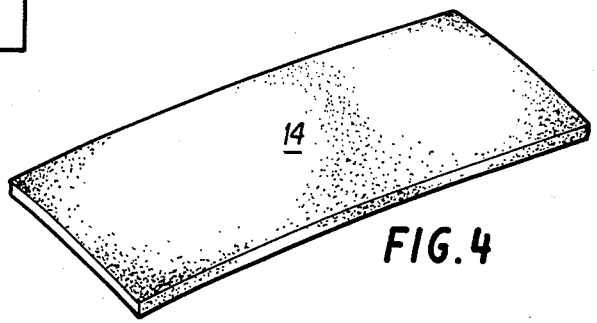
FIG. 4 is an isometric view of a sheet of foam material which, forms an element of the FIG. 1 structure.

A better understanding of the construction of the sleeping apparatus of FIG. 1 can be obtained with reference to FIGS. 2 and 3 which respectively depict a blank sheet of heavy-woven broadcloth 34 from which the container portion 20 is sewn and a blank sheet of flannel 36 from which the cover sheet 22 is sewn. The sheet of broadcloth 34 is 52 inches wide and slightly more than 6 feet long (to make a 6 feet long seeping apparatus 10). The sheet of broadcloth 34 is folded at a middle line, represented by a dashed line 38 in FIG. 2. The flannel sheet 36 is 45 inches wide, which is approximately 19 inches wider than the folded sheet of broadcloth 34, and about as long as the broadcloth. The flannel sheet is gathered at its foot end 32 so that its sides are pulled in to the dashed lines 40 shown in FIG. 3. The foot end 32 of the flannel sheet 36 is placed between folds of the sheet of broadcloth 34 and they are all sewn together to form a foot seam 26. Of course the ties 16 are also sewn at the seam 26, however, they are not shown in FIGS. 2 or 3 for purposes of simplification.

Side edges 42 of the sheet of broadcloth 34 are sewn together to form the side 24A of the container. Side 24B, of course, is formed by the fold at line 38. A zipper is installed at the end edge 44 of the sheet of broadcloth 34.

The pillow 18 is formed of a container of flannel having something soft inside, however, it should be understood that this invention does not depend on the features of the pillow 18, the pillow being described only for purposes of completeness.

A 24 inch by 2 inch by 6 feet sheet of foam material 14 will fit snugly into the container portion 20 made in accordance with the above-mentioned dimensions.

In use, the sleeping apparatus of this invention is folded into a roll as depicted in FIGS. 5 and 6 with the ties 16 extending thereabout and tied at bows 46. When thusly folded, the roll can be easily stored and transported. In order to use the sleeping apparatus 10, one places the roll 48 on a floor and unties the bows 46 allowing the resiliency of the sheet of foam material 14 to unroll the roll 48 by itself. In order to lie on the sleeping apparatus 10, one lifts the cover sheet portion 22, lies on the container portion 20 (with the enclosed sheet of foam material 14), with his feet directed toward the foot end seam 26 and covers himself with the cover sheet portion 22.

The fact that the cover sheet portion 22 is wider than the container portion 20 ensures that the cover portion 22 hangs down on the sides of a person lying on the container portion 20. These extra-width flanks are folded onto the container portion 20 when the sleeping apparatus 10 is folded into a roll. The sheet of foam material 14 which is inside the container portion 20 provides firm, soft and comfortable support for the person lying on the container portion 20 while the cover sheet portion 22 keeps him warm, but yet does not in any way restrict his movements inasmuch as it is not at all fastened at the sides 24A and B of the container portion 20. The device of this invention is particularly convenient in that the sheet of foam material 14 is easily removable from the container portion 20 through the opening covered by the zipper 30 to wash the composit container portion/sheet portion in a washing machine. The device is extremely inexpensive to construct, there really being only two joining seams and a zipper to install to completely construct the apparatus. Of course, those skilled in the art will realize that edge seams are necessary to prevent unraveling. The fact that the cover sheet 22 is only attached to the foot seam of the containing portion 20 not only makes the device more comfortable to use, but reduces its manufacturing costs.

While the invention has been particularly shown and described with reference to a preferred embodiment, it will be understood by those skilled in the art that various changes in form and detail may be made therein without departing from the spirit and scope of the invention. For example, the opening for inserting and removing the sheet of foam material 14 could be at a side 24A or B of the container portion 20 instead of being at the head end 28 as depicted in FIG. 1. This arrangement is not thought to be quite as satisfactory as the depicted embodiment because it requires a longer zipper which adds both to the amount of work and to the cost of materials for the device. With such an arrangement the other edges would be sewn closed.

The embodiments of the invention in which an exclusive property or privilege are claimed are defined as follows:

1. A portable lounging apparatus comprising:

A single, integral, thin rectangular sheet of resilient foam material having a sufficient firmness that when it is spread out it provides a comfortable support on a floor for a human body lying thereon, said integral resilient foam material sheet being sufficiently resilient that it can be easily folded into a roll for carrying and handling, being sufficiently flexible that it is not damaged by repeated folding and unfolding thereof, being sufficiently strong that the previously mentioned activities do not cause disintegration of it over a long period of use and being of such a size as to hold a human body thereon;

a cloth container having a size and shape approximately the same as that of said single, integral, thin rectangular sheet of resilient foam material for snugly enclosing said sheet of resilient material therein, said cloth container having a foot-end edge, a head-end edge, and two side edges, one of said head-end edge or a side edge of said cloth container having an opening therein through which said sheet of resilient foam material can be selectively inserted into said cloth container and removed therefrom, said cloth container including a closure means for selectively opening and closing said opening, the foot-end edge of said cloth container and the other of said side and head edges being permanently closed, said cloth container being constructed of a durable cloth material; and, a rectangularly-shaped cloth cover sheet having a foot-end edge and a head-end edge, said cover sheet being substantially wider than the fully-extended width of said cloth container, the foot-end edge of said cover sheet however being permanently sewn by a seam to the foot end edge of said cloth container with the sides of said cover sheet extending substantially laterally beyond the side edges of said cloth container but not being attached to said side edges, the foot-end edge of said cover sheet being gathered to make the size of the foot-end edge of said cover sheet approximately match that of the fully-extended foot-end edge of said cloth container said gathered portions being permanently sewn by said seam to the foot end edge of the cloth container along with the rest of said foot-end edge of said cover sheet, the two side edges of said cloth container remaining substantially unattached to any sheets, said cover sheet being constructed of softer material than the cloth container and having a length for substantially covering a person lying on said cloth container.

2. A sleeping apparatus as claimed in claim 1, wherein is further included tie means sewn into the foot end seam for encircling said sleeping apparatus when it is folded into a roll for maintaining said sleeping apparatus in said roll but being releasable to allow said sleeping apparatus to unroll for use.

3. Sleeping apparatus as claimed in claim 1, wherein said single, integral, thin rectangular sheet of resilient foam material is constructed of a polyurethane foam.

4. Sleeping apparatus as claimed in claim 1, wherein said cloth container is constructed of broadcloth.

5. Sleeping apparatus as claimed in claim 4, wherein said cloth cover sheet is constructed of flannel.

6. Sleeping apparatus as claimed in claim 1, wherein said cloth cover sheet is constructed of flannel.

7. Sleeping apparatus as claimed in claim 1, wherein said cloth container is constructed of one piece of cloth which is folded over and the cover sheet is also constructed of one sheet of cloth sewn into the foot seam of the container.

8. Sleeping apparatus as claimed in claim 1, wherein said opening is in said head-end edge.

* * * * *